US007150119B1

(12) United States Patent
Nudo, Jr.

(10) Patent No.: US 7,150,119 B1
(45) Date of Patent: Dec. 19, 2006

(54) HONEYCOMB SIGN BOARD

(76) Inventor: Samuel Nudo, Jr., 4908 Bears Paw, Springfield, IL (US) 62707

( * ) Notice: Subject to any disclaimer, the term of this patent is extended or adjusted under 35 U.S.C. 154(b) by 45 days.

(21) Appl. No.: 10/855,637

(22) Filed: May 28, 2004

(51) Int. Cl.
*G09F 19/00* (2006.01)

(52) U.S. Cl. ..... 40/615; 428/138

(58) Field of Classification Search ..... 40/615; 428/137, 138
See application file for complete search history.

(56) References Cited

U.S. PATENT DOCUMENTS

| | | | | |
|---|---|---|---|---|
| 1,148,114 | A | 7/1915 | Morris et al. | |
| 1,590,722 | A | 6/1926 | Brakmeier | |
| 3,274,315 | A | 9/1966 | Kawamura | |
| 3,469,335 | A | 9/1969 | Leigh | |
| 3,741,857 | A | 6/1973 | Kakutani et al. | |
| 4,454,691 | A | 6/1984 | Mitchell | |
| 4,658,527 | A | 4/1987 | Pingel | |
| 4,707,393 | A | 11/1987 | Vetter | |
| 4,805,324 | A | 2/1989 | Anderson | |
| 4,894,937 | A | 1/1990 | Davis | |
| 4,928,415 | A * | 5/1990 | Walters | 40/610 |
| 5,042,183 | A | 8/1991 | Kennedy | |
| 5,103,582 | A | 4/1992 | Farmer | |
| 5,307,580 | A | 5/1994 | Farmer | |
| 5,566,483 | A | 10/1996 | Ogren | |
| 6,170,183 | B1 | 1/2001 | Keefe | |
| 6,258,199 | B1 * | 7/2001 | Lingamfelter et al. | 156/235 |
| 6,262,807 | B1 * | 7/2001 | Pleotis | 358/1.2 |
| 6,470,610 | B1 | 10/2002 | Northey | |
| 6,497,062 | B1 * | 12/2002 | Koopman et al. | 40/301 |
| 6,677,021 | B1 * | 1/2004 | Barnette et al. | 428/40.1 |
| 2002/0121033 | A1 * | 9/2002 | Hildyard et al. | 40/586 |
| 2005/0039363 | A1 * | 2/2005 | Galey | 40/607.03 |

* cited by examiner

*Primary Examiner*—Gary C. Hoge

(57) ABSTRACT

A weather resistant honeycomb laminated sign board panel for use in sign manufacturing. The honeycomb sign board panel displays a message through a dark vinyl display layer through a novel lamination and routing process in which a message is cut through the vinyl layer and into a light colored core. The core layer is made of high molecular weight, high density polyethylene having a plurality of channels.

4 Claims, 3 Drawing Sheets

HONEYCOMB SIGN BOARD

BACKGROUND OF THE INVENTION

1. Field of the Invention

The present invention relates to the field of signboard and methods of manufacturing signboard.

2. Background Information

Signboard is a commonly used term for defining the materials used to manufacture a sign. Composite signboard was first made of wood products and those signboards were developed before the discovery of the west. Wooden signs with paper facing for displaying a message were used centuries ago in Asia.

Laminated signboards, as used today are divided into interior or exterior use. Illuminated signs are usually formed of metal and plastic. Wood signs are used today primarily for their decorative appearance. The wood is normally treated if the intended is for outdoors. Laminated wood, metal and plastic signs are also common and are used to house other components such as wires or optional displays.

A popular signboard for outdoor use is plastic honeycomb with bonded sheets of thin aluminum. The aluminum sheets carry a message which is graphically printed on the sign. Although this type of signboard is commonly used out doors, the bond delaminates the aluminum from the plastic over time due to weather.

Plastic honeycomb is also a well known material for use as signboard although the use of plastic honeycomb is common, the plastic is difficult to handle during printing and the message deteriorates wit the hot and cold weather conditions. There is a need for an outdoor plastic signboard which will withstand inclement weather conditions over time yet remain simple to manufacture.

SUMMARY OF THE INVENTION

Sign board formed of layers of interacting sheets is provided to display a commercial or a residential message using a refractive background. A fiberglass reinforced core presents a rigid inner stabilizer for high density polyethylene background materials. A pair of textured vinyl sheets presents a stylized surface for presenting a message.

It is an object of the present invention to provide a method of making a signboard using a stabilizer core of fiberglass reinforced plaster and a pair of refractive high density polyethylene sheets.

Another object of the present invention is to provide a signboard having a durable and weather proof structure.

Yet another object of the present invention is to provide a signboard made of interactive layers which assist each other due to their inheritances.

Another object of the present invention is to present a signboard having refractive inner sheets of high density polyethylene.

Still another object of the present invention is to provide a sign board with a complete structure for delivering to a vendor for cutting customer messages.

The honeycomb signboard panel of the present invention has a series of layers which interact with each other to present a unique and durable sign that fails to warp under in climate weather. A honeycomb fiberglass reinforced plastic core is covered with layers of textured vinyl. A message is routed through the vinyl layers and into the core such that the color of the core exhibits through the vinyl layers.

BRIEF DESCRIPTION OF THE DRAWINGS

The present invention detailed is illustrated by way of example and not limitation in the following figures.

DESCRIPTION OF THE PREFERRED EMBODIMENTS

A honeycomb signboard and a method for making a laminated honeycomb signboard panel are disclosed. In the following description, numerous specific details are set forth in order to provide a through understanding of the present invention. It will be apparent, however, to one of ordinary skill in the art that the specific detail need not be employed to practice the invention. In other instances, well-known materials or methods have not been described in detail in order to avoid obscuring the present invention.

Reference throughout this specification to "one embodiment or an embodiment means that a particular feature, structure or characteristic described in connection with the embodiment is included in at least one embodiment of the present invention. Thus, appearances of the phrases in one embodiment or in an embodiment in various places throughout the specification are not necessarily all referring to the same embodiment. Furthermore, the particular features, structures or characteristics may be combined in any suitable manner in one or more embodiments.

Figure 1:
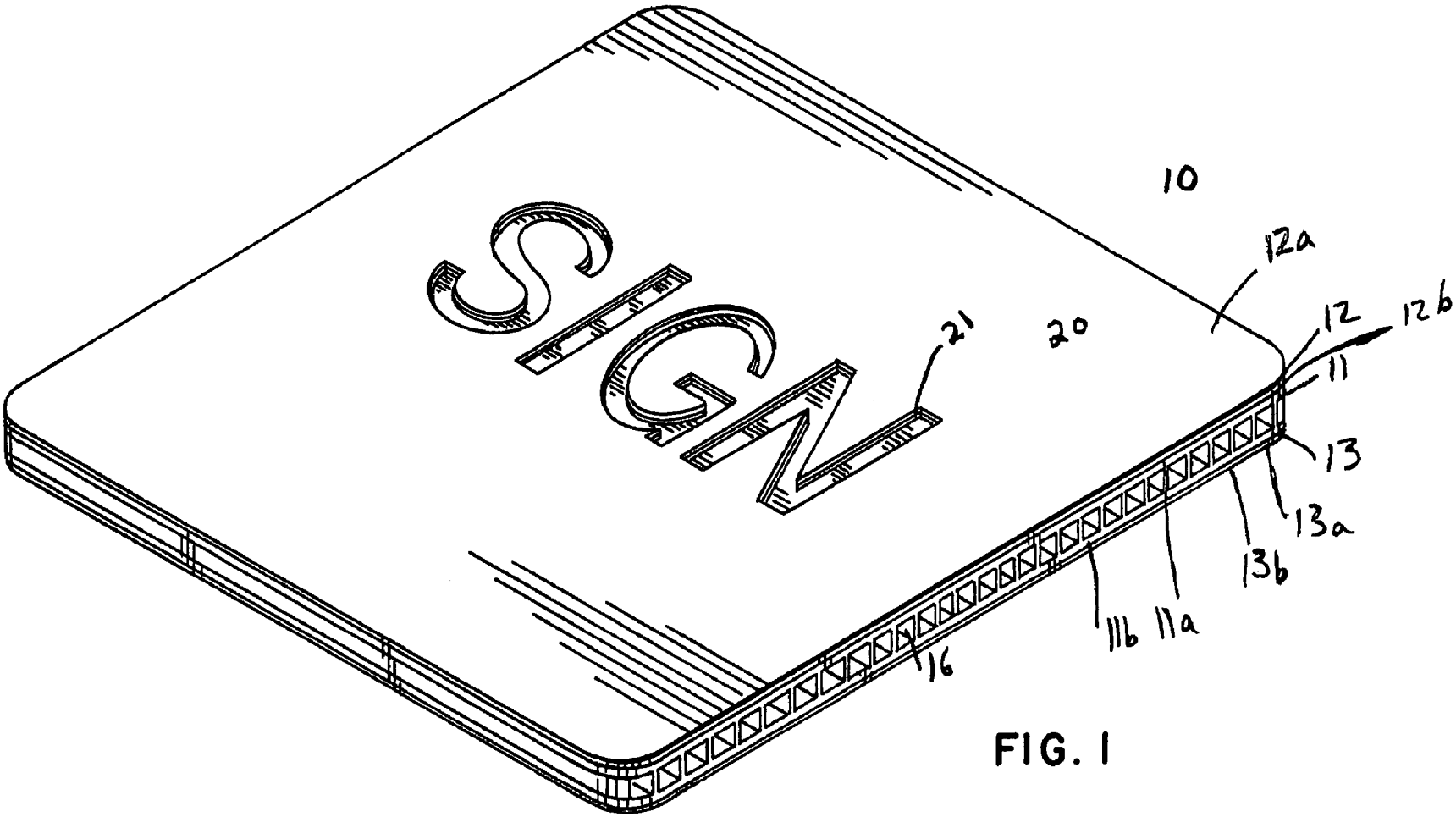
FIG. 1 is a perspective view of a honeycomb signboard panel in accordance with the teachings of the present invention.
Figure 2:
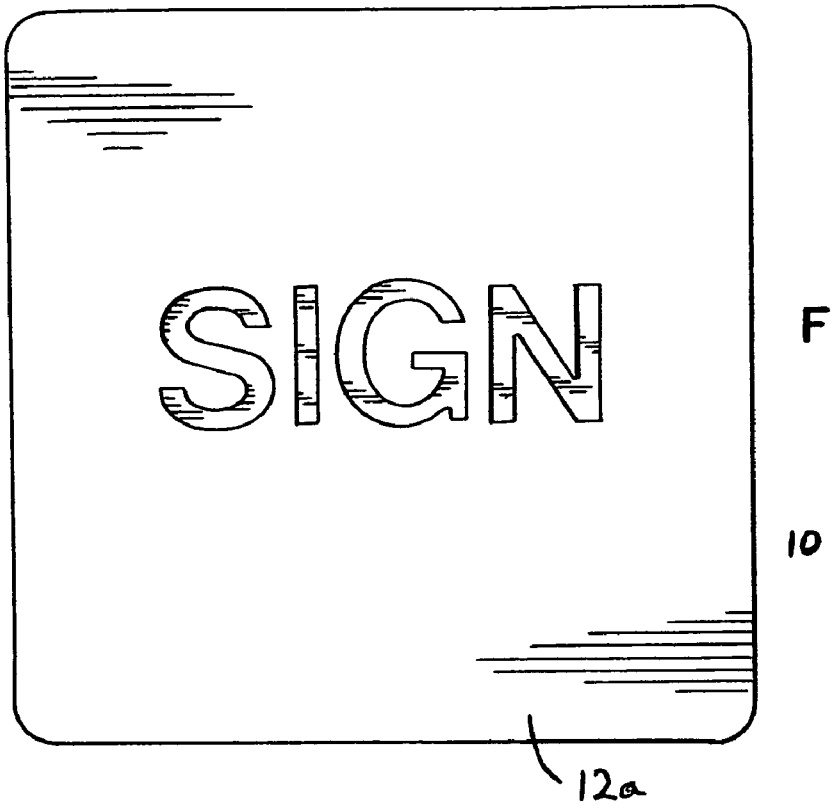
FIG. 2 is a front view of the honeycomb signboard panel in accordance with the teachings of the present invention.
Figure 3:
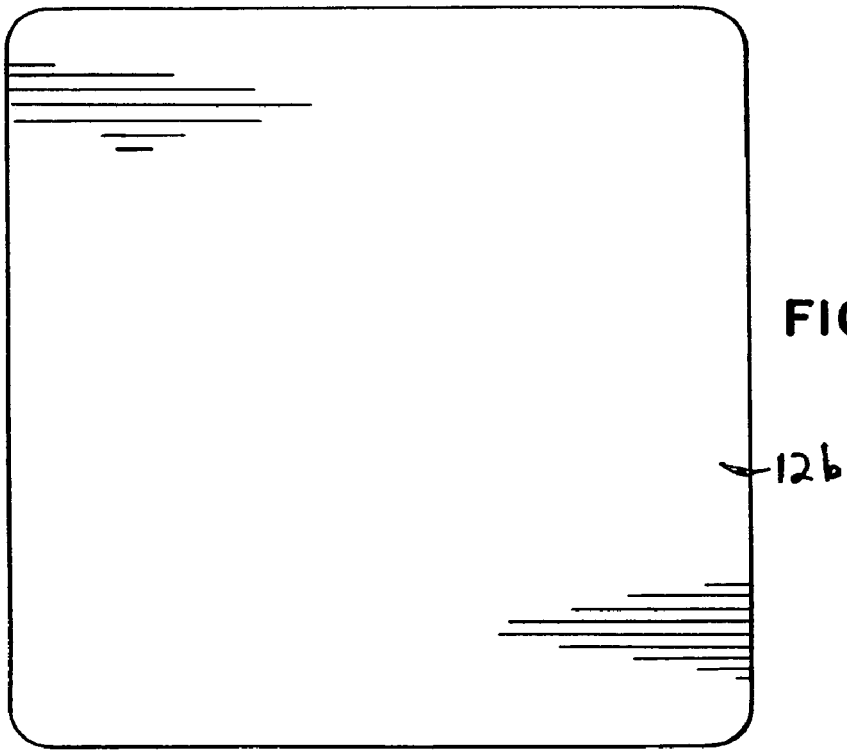
FIG. 3 is a rear view of the honeycomb signboard panel in accordance with the teachings of the present invention.
Figure 4:
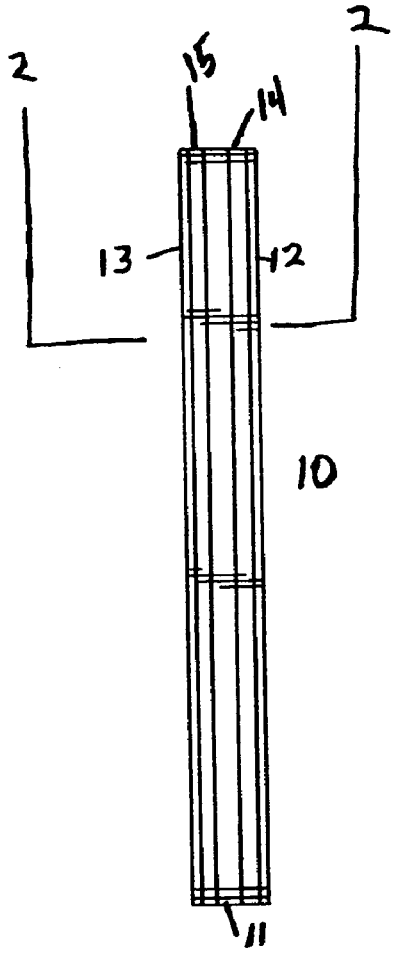
FIG. 4 is a side view of an alternative embodiment of a honeycomb signboard panel in accordance with the teachings of the present invention.
Figure 5:
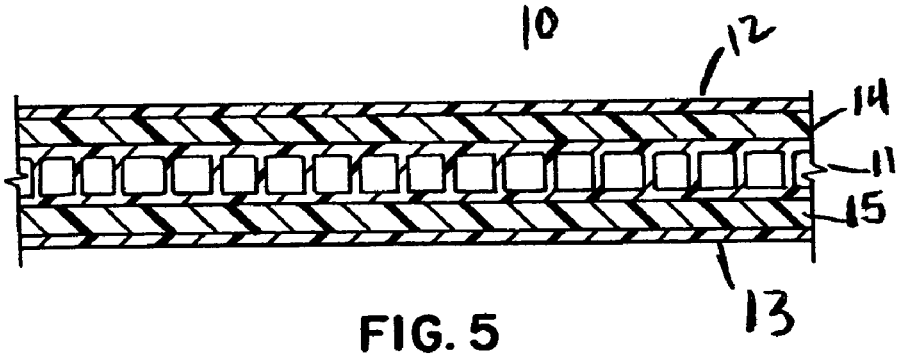
FIG. 5 is a top top cross sectional view of the honeycomb signboard panel taken along lines 2—2 of FIG. 4 in accordance with the teachings of the present invention.

As an overview, embodiments of the present invention provide a honeycomb laminated signboard panel for outdoor use in a variety of climates. In FIG. 1, a honeycomb sign board panel 10 of the present invention is illustrated in a perspective view. The laminated sign board panel 10 has a plurality of layers 11—13 which are laminated with pressing in a novel process to form the honey comb laminated sign board panel 10 of the present invention. Honeycomb layer 11 provides a core of brilliant reflective plastic and is made of high molecular weight high density polyethylene (HDPE). HDPE is a thermoplastic polyolefin manufactured by the polymerization of ethylene. Ethylene is the main building block of PE but small amounts of other co-monomers such as butene-1, hexene-1 or octene-1 are often used for modifying the polymer properties. For HDPE, the co-monomer level is typically not over 1–2%. The specific properties of each HDPE grade are a combination of four primary variables: density, molecular weight, molecular weight distribution (MWD) and additives. Different catalysts are also used to customize polymers for specific performance characteristics. These variables are combined to produce grades that offer an optimum balance of properties for different applications.

PE MWD varies from narrow to broad depending on the catalyst and process used. Narrow MWD provides low warp age and high impact for molding processes. Medium to broad MWD provides better processing needed for most extrusion processes. Broad MWD also improves melt strength and resistance to creep. HMW-HDPE further provides excellent environmental stress-crack resistance, impact strength and high tensile strength. Its excellent melt strength allows the high draw ratios necessary for down gauging products. Ultra High-Molecular Weight (UHMW) polyethylene has polymer chains 10–20 times longer than HDPE. The longer chains give major advantages in toughness, abrasion resistance and ESCR. A particularly suitable polyethylene is a high molecular weight polyethylene (HMWPE) such as a 5100 series high molecular weight polyethylene available from various suppliers such as General Electric, referred to herein occasionally as "HMWPE 5100". Comparable polyethylenes are also available under the trade names PAXON BA5O-100 from Allied and MARLEX HXM 50100 from Phillips. Other polyethylene resins can be used, such as the Dupont ELTREX B5920 high density polyethylene.

Honey comb core layer 11 and has a top surface 11*a* and a bottom surface 11*b*. Each surface 13*a*, 13*b* is prepared for a lamination process by shaving the high density polypropylene surfaces until a reflective shine is displayed by the surfaces. Shaving is defined as scraping each surface with a razor in order to peel off a portion of the surface of the layer. The layer 13 is further made of a color which provides a distinctive or vivid image 20 to a viewer when displayed through the layers 11, 12, 14, 15 which are made of a contrasting color.

Outside layers 12 and 13 are made of vinyl in any contrasting color that provides a background for image 20. Each layer has a first surface 12*a*, 13*a* and a second surface 12*b*, 13*b*. Vinyl surfaces 12*a*, 13*a* have a textured finished for the surfaces. Vinyl layers are provided with textured surfaces which assist in preventing an ornate background for the messages. Surfaces 12*b* and 13*b* are bonded to the honeycomb core 11 to form the completed the honeycomb laminated sign board panel 10. Surfaces 12*a* and 13*a* may have reflective surfaces or textured surfaces to provide an enhanced background for image 20.

The honeycomb laminated sign board panel 10 is assembled by first laminating the layers 12 and 13 to core 11 with the textured surfaces 12*a*, 13*a*, provided on the outside of the honeycomb laminated sign board panel. Adhesive is used to bond each of the layers to the corresponding layer. Following lamination, the sign board panel is pressed for at least 24 hours until cured.

The image 20 is formed in the signboard by a unique routing process. A computer operated router is used to scribe a message in the surface 11*a* and/or 15*a* of the panel. The router may be programmed to scribe any message. The router has a stylist that forms a series of letters into the panel at a predetermined depth. Since the vinyl layers are approximately ¼ inches thick, the router is preset to cut into the panel about ½ inch. Scribe line 21 is formed completely through the vinyl layer 12*a* and into the HDPE layer 14*a* about ⅛ of an inch. The message cut by the router has a reflective appearance due to the HDPE as the message appears through the vinyl. The preferred embodiment uses a dark colored vinyl and white HDPE.

In an alternative embodiment, layers 14 and 15 are added for strength. Each layer is made of fiberglass reinforced plastic (FRP). The fiberglass reinforced plastic layers have a thickness of 3/16–½ inches. Each layer has a first surface 14*a*, 15*a* and a second surface 14*b*, 15*b*. In this embodiment, each layer is laminated to surfaces 11*a*, 11*b* of core layer 13. Bonding is achieved using any suitable polyurethane adhesive. These layers provide strength to the signboard and prevent warping of the sign. Routing is accomplished by cutting through the vinyl layer and through the FRP layer. Layers 14 and 15 may also be made with low density polyethylene.

Each honeycomb signboard panel 10 may have a different thickness depending on the intended use of the sign so the router is usually mounted on the substrate for scribing to a specific depth. The depth will depend on the thickness of layers 14 and 15. In the preferred embodiment, layer 15 has a thickness of between $1/16^{th}$–$3/8^{th}$ inches and layer 14 has a thickness between $1/8^{th}$ and 1 inch. The router forms a message by cutting scribe line or groove 21 which extends through layers 11, 12, 14, and 15 and into layer 13. The composition of the high density polyethylene provides a reflective colorful surface when cut by a router having a blade that scrapes the material during cutting. As a result, an image 20 is provided in the form of a message which contrasts with the background provided by the vinyl surface 15*a*.

The core of the substrate is a novel concept to ensure that the final laminate remains planar during outdoor use. The core 11 is provided with channels 16 which extend from one end on the sign to the other end. Through experiment, applicant has found that HDPE may warp without an interior core that can withstand outdoor weather conditions. Tests show that FRP combined with HDPE will prevent warping over a 5 year period under extreme hot and cold conditions. The substrates were tested outdoors for 5 years where conditions in the winter reached −35° and 100° in the summer. Other tests using FRP as the honeycomb core and HDPE instead of FRP layers 14, 15 have produced similar results.

The completed honeycomb sign board panel 10 provides a brilliant message provided by the HDPE reflective surface contrasts off the vinyl covering. The fiberglass reinforced HDPE core prevents the signboard from warping during in climate conditions. The signboard, formed in accordance with the present invention, can withstand inclement weather conditions unlike signs made of metal or plastic. Due to the unique laminated formation, the signboard panel 10 will not warp due to hot or cold weather as the FRP layers 14 and 15 provide a rigid support for the vinyl background and the high density polyethylene.

What is claimed is:

1. A honeycomb laminated sign board panel for displaying a message through at least one layer on at least one side of said sign board panel, said sign board panel comprising:

a core layer made of high molecular weight, high density polyethylene, said core layer having a first bonding surface, a second bonding surface, and a plurality of channels, a first interior layer and a second interior layer, said first interior layer and said second interior layer made of fiberglass reinforced plastic, said first interior layer bonded to said first bonding surface and said second interior layer bonded to said second bonding surface to prevent said panel from warping and to strengthen said panel, said first interior layer and said second interior layer having a thickness of 3/16–½ inches, and a first vinyl display layer and a second vinyl display layer, said first vinyl display layer and said second vinyl display layer having a message routed to form an opening therein, said first vinyl display layer bonded to said first interior layer and said second vinyl display layer bonded to said second interior layer.

2. The honeycomb laminated sign board panel as recited in claim 1, said laminated sign board panel further comprising a color coded message.

3. A honeycomb laminated sign board panel for displaying a message through at least one layer on at least one side of said sign board panel, said sign board panel comprising:

a core layer made of high molecular weight, high density polyethylene, said core layer having a first bonding surface, a second bonding surface, and a plurality of channels, said core layer having reflective surfaces formed by shaving, a first interior layer and a second interior layer, said first interior layer and said second interior layer made of plastic, said first interior layer bonded to said first bonding surface and said second interior layer bonded to said second bonding surface to prevent said panel from warping and to strengthen said panel, said first interior layer and said second interior layer having a thickness of 3/16–1/2 inches, and a first vinyl display layer and a second vinyl display layer, said first vinyl display layer and said second vinyl display layer having a message routed to form an opening therein, said first vinyl display layer bonded to said first interior layer and said second vinyl display layer bonded to said second interior layer.

4. The honeycomb laminated sign board panel as recited in claim 3, said laminated sign board panel further comprising a color coded message.

* * * * *